US005359958A

United States Patent [19]

Guild

[11] Patent Number: 5,359,958

[45] Date of Patent: Nov. 1, 1994

[54] HIGH-SPEED WATERCRAFT

[76] Inventor: Johnithan R. Guild, P.O. Box 504, Sonoma, Calif. 95476

[21] Appl. No.: 239,246

[22] Filed: May 6, 1994

[51] Int. Cl.[5] ..... B63G 1/16

[52] U.S. Cl. ..... 114/272; 114/283; 114/274

[58] Field of Search ..... 114/271–274, 114/283, 284, 288–290, 61; D12/309, 310, 311, 312, 313

[56] References Cited

U.S. PATENT DOCUMENTS 2,255,046 9/1941 Diehl ..... 114/274
3,952,678 4/1976 Weston ..... 114/272

FOREIGN PATENT DOCUMENTS 60923 11/1937 Norway ..... 114/274

*Primary Examiner*—Edwin L. Swinehart
*Attorney, Agent, or Firm*—Larry D. Johnson

[57] ABSTRACT

A high-speed watercraft provides a fast hydroplane craft, powered by a large gas turbine, that will plane over the surface of the water at high speed using a catamaran-type hull mounted on two long, flat-bottom pontoon skis with water chutes under the back end, with steering done from the front with a combination rudder/water chute. The turbine exhausts through a movable nozzle in the back that can be directed up or down by a hydraulic (or mechanical) actuator towards the surface of the water. The watercraft includes a large high, wide dual tail section having a tail wing and tail flap for control, and a large arch frame over the top from the front to the back with rods coming down to the gunnel to give the hull more strength. The craft also includes a front pontoon ski, a pair of middle pontoon skis, and a pair of aft pontoon skis. Finally, the craft includes a belly plate underneath near the back that acts like an after-ski with water chutes under the aft pontoon skis. Flat plates under the front of the skis mounted on pins. This will make the craft more stable to handle, less top heavy, better control, more floating buoyancy to skim over the surface of the water at high speeds and smoother riding.

3 Claims, 5 Drawing Sheets

HIGH-SPEED WATERCRAFT

BACKGROUND OF THE INVENTION

1. Field of the Invention

This invention relates generally to boats and other watercraft, and more specifically to an improved high-speed type of watercraft (such as hydrofoils and hydroplanes).

2. Description of the Prior Art

Numerous versions of high-speed boats have been designed. However, most known high-speed boats are difficult to control and are prone to becoming airborne, spinning out, rolling, or even turning over, particularly in rough seas.

SUMMARY OF THE INVENTION

The high-speed watercraft of this invention provides a fast hydroplane craft, powered by a large gas turbine (it can also be powered by water propellers or air propellers), that will slide over the surface of the water at high speed using a catamaran-type hull mounted on two long, flat-bottom pontoon skis with water chutes under the back end, with steering done from the front with a combination box rudder/water chute. The turbine exhausts through a movable nozzle in the back that can be directed up or down by hydraulic (or mechanical) means towards the surface of the water. The watercraft includes a large high, wide dual tail section having a tail wing and tail flap for control, and a large arch frame over the top from the front to the back, with rods coming down to the gunnel to give the extra-long hull more strength. The craft further includes a belly plate underneath near the back that acts like an after-ski. Finally, the craft includes the following series of skis/pontoon skis:

Front Ski: A pontoon ski mounted between the two pontoons in front. This will create a full ski in front, not all the way back. The front of this center section is curved up about twelve inches and the bottom extends back about three feet. Joined between the two skis or welded on both sides on the bottom and front (i.e., a pontoon curved up in front).

Middle Pontoon Skis: One on both sides about half way back. Three feet wide, four feet long, twelve inches high. Built to the side of the craft, and braced going up from the approximate center of the pontoons at an angle to the side of the hull.

Aft pontoon skis: Spaced out about four feet from the back, extending further back, and spaced out from the sides, beyond the wake of the center skis, located further out from the sides than the middle pontoon skis. Three and one-half feet wide, four and one-half feet long, approximately, with braces going up at an angle from the middle of the top of the pontoons to the side of the tail section, and a brace going forward at an angle joined to the side of the hull up twenty inches from the bottom, and straight braces from the top of the pontoons to the side of the craft. They have to be out of the wake of the skis in front of them while going forward. To lift properly, the back of the ski will always go down. The back ski will raise the back of the craft, and allow the craft to plane over the surface of the water at high speeds.

This is a very important feature. It will raise the back of the craft, and makes for smoother riding over the surface of the water with better control, by spacing these three sets of pontoon skis along the length of the craft further out as you go towards the stern. This will lift the craft all along the length of the craft, and it will plane evenly while going forward at high speeds and skim across the surface of the water.

This added feature of having center skis and aft skis spaced further out from the sides is what makes this invention different from previous art. You have skis lifting the front, and skis lifting the middle, and skis lifting the back.

The front part of each of the pontoon skis breaks the surface of the water and urges the ski up while going forward. By having short skis in the middle and back, each spaced further out from the craft than the ones in front of them, each of the skis will plane over undisturbed water, and not incur any wake, spray or other interference from the ski in front of it.

Thus, when the watercraft is moving at speed across the water, only the following components are in contact with the water: the box rudder, the front ski, the stern water chutes, the pontoon skis, the belly plate, water chutes under the after pontoon skis (three and one-half feet wide, three feet long, and one foot high approximately), and the flat plate under the front of the skis (mounted on eight pins three-eighths diameter, four feet long, twelve feet wide, twelve inches down from the bottom of the skis to keep the front from going up and down).

This hydroplane craft is capable of going more than one hundred miles per hour over the surface of the water, while still maintaining a good and steady control of the craft and not bouncing around and rolling, or the back spinning around and turning over. This new hydroplane design will overcome these problems and make the high-speed surface craft safer, more dependable and more comfortable to ride. The design of this hydroplane is a great improvement over previous designs where one would lose control over the craft when going at high speeds, will be much safer and better to control in rough seas, and will ride much smoother.

DETAILED DESCRIPTION OF A PREFERRED EMBODIMENT

Figure 1:
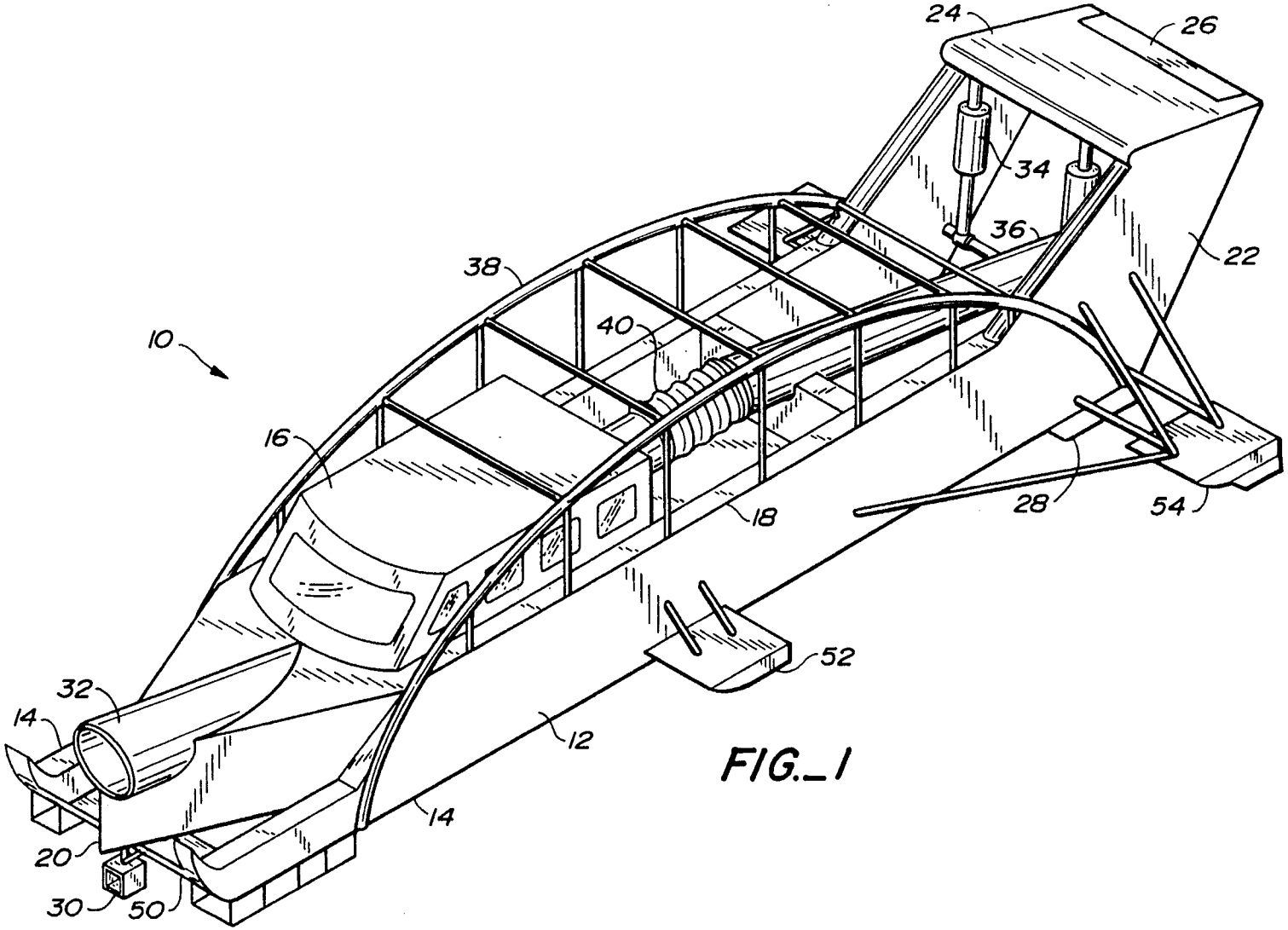
FIG. 1 is an upper frontal perspective view of the high-speed watercraft of this invention.
Figure 2:
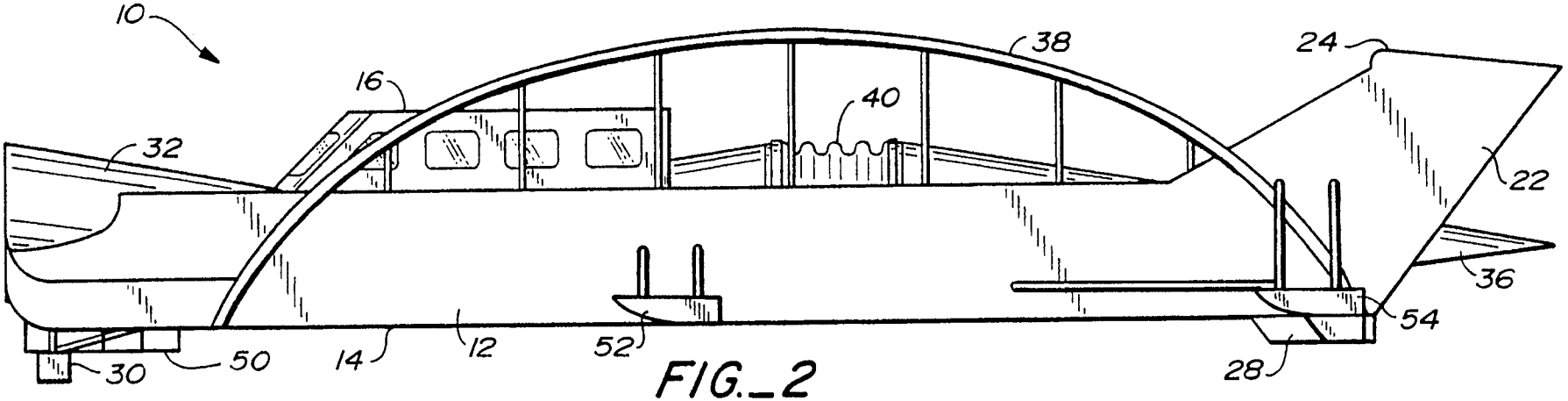
FIG. 2 is a right side elevation view of the high-speed watercraft of this invention.
Figure 3:
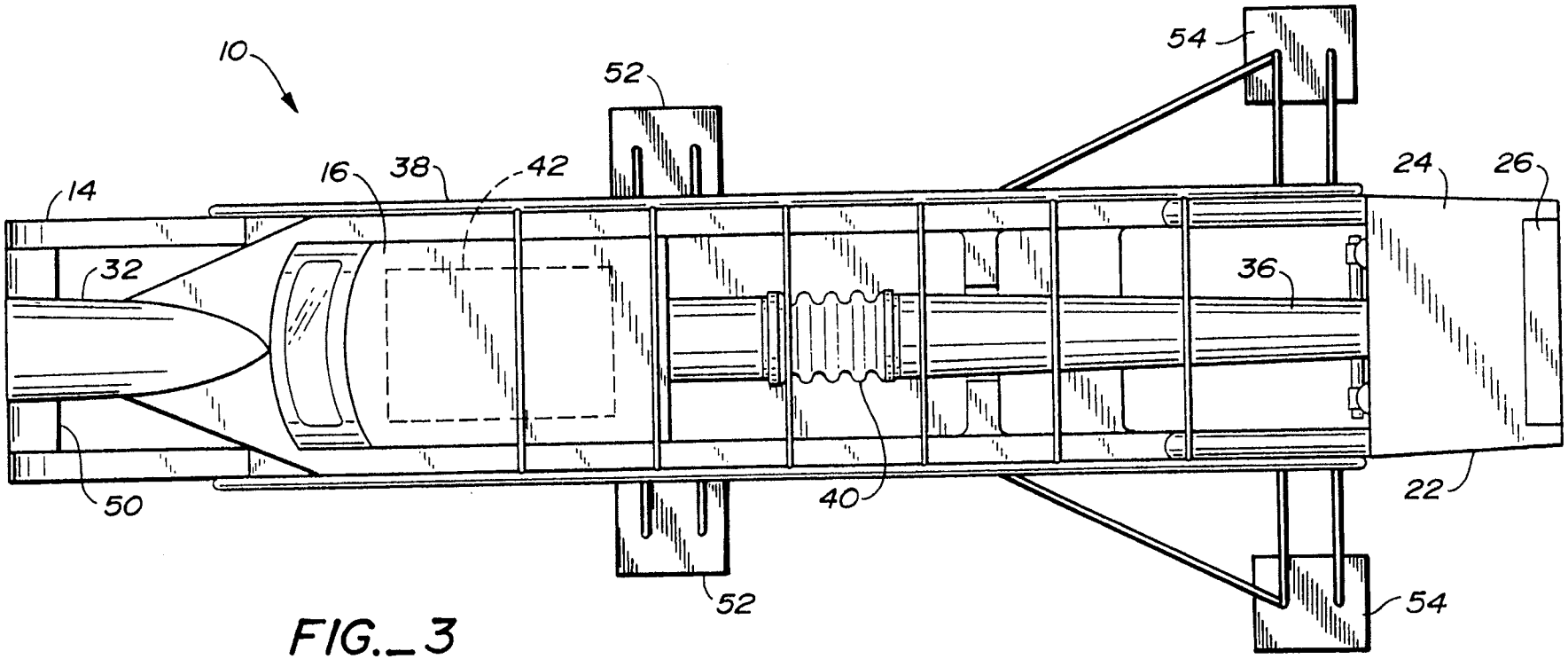
FIG. 3 is a top plan view of the high-speed watercraft of this invention.
Figure 4:
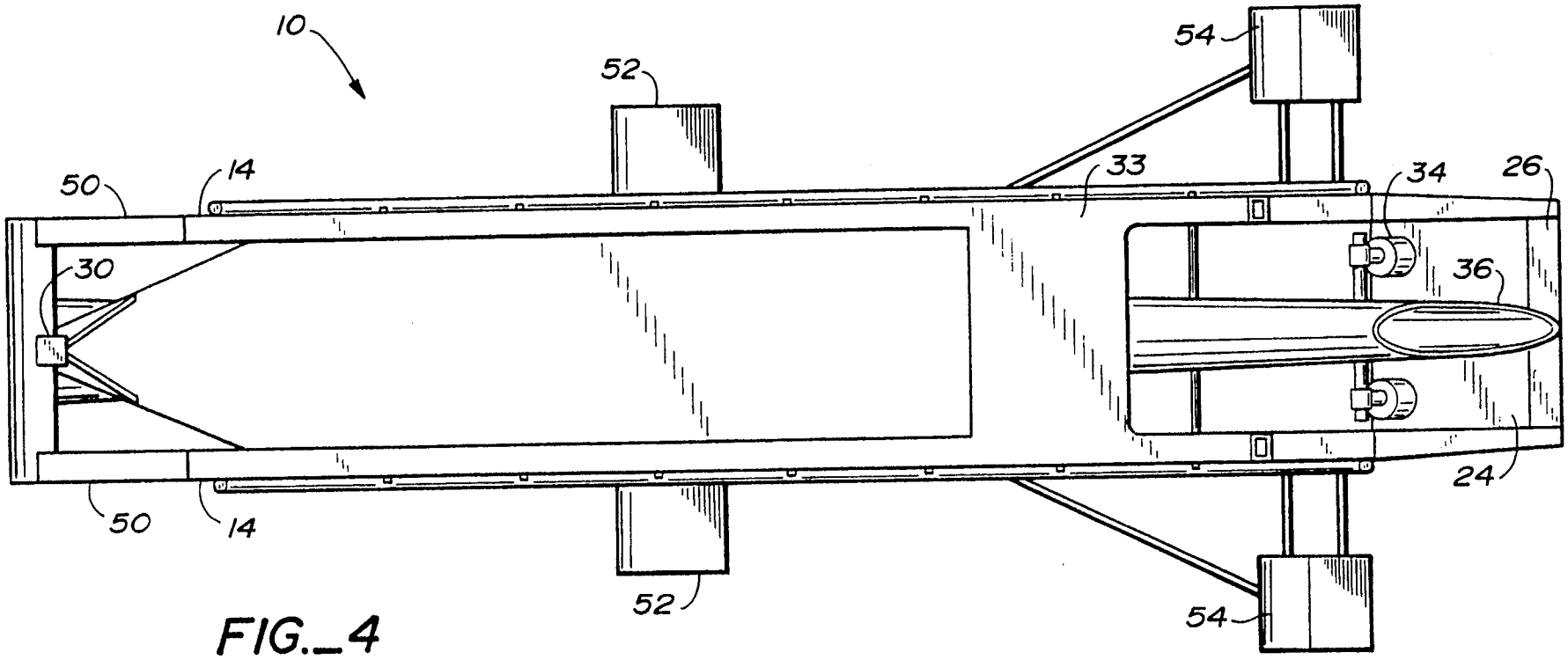
FIG. 4 is a bottom plan view of the high-speed watercraft of this invention.
Figure 6:
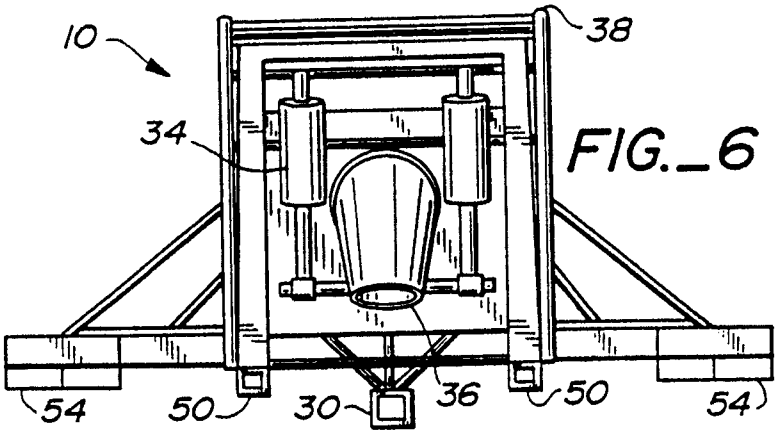
FIG. 6 is a rear elevation view of the high-speed watercraft of this invention.
Figure 5:
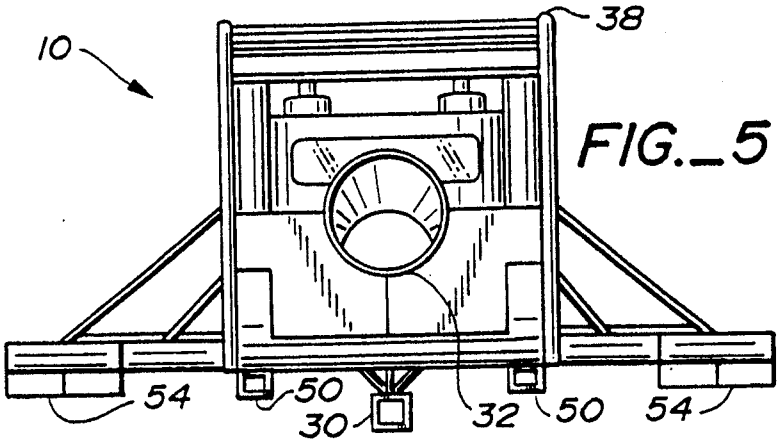
FIG. 5 is a front elevation view of the high-speed watercraft of this invention.

FIG. 1 is an upper frontal perspective view of the high-speed watercraft of this invention;

FIG. 2 is a right side elevation view of the high-speed watercraft of this invention;

FIG. 3 is a top plan view of the high-speed watercraft of this invention;

FIG. 4 is a bottom plan view of the high-speed watercraft of this invention;

FIG. 5 is a front elevation view of the high-speed watercraft of this invention; and FIG. 6 is a rear elevation view of the high-speed watercraft of this invention.

The high-speed watercraft 10 of this invention includes a catamaran-like hull 12, square mounted on two pontoon skis 14, the hull being about ten feet wide and about sixty feet long, and about eight feet high from the bottom of the skis to the top of the cab 16. From the skis 14 to the gunnel 18 is five feet, and from the wedge-shaped bow 20 to the cab 16 is about ten feet. The two pontoon skis 14 extend beneath the hull about eighteen inches, are about twelve inches wide, and stick out in front on both sides of the hull 12 for ten feet, with the front of each of the pontoon skis curled up. There is a large dual tail section 22 with a wing 24 across the top, and a tail flap 26 much like on an airplane.

The stern water chutes 28 under the back of the pontoon skis are four feet long and tapered upward on their leading edge. They are square, twelve inches high and twelve inches wide, open on both ends, and made of twelve-gauge metal. The water chutes 28 keep the craft from going sideways and help hold the craft steady in the water, with far less up-and-down movement of the stern.

Box-type rudder 30 under the front is twelve inches square, open in the front and back, and also made of twelve gauge metal. It sets down into the water about twelve inches below the bottom of the skis 14 with braces running back and upwards, and a shaft extending up through the front of the bow. There is a sleeve and a packing gland around the shaft, and there is a tapered guard in front of the sleeve. The steering is done in the front with this rudder (a regular rudder would work also but the box type additionally acts like a water chute and helps prevent the bow from going up and down). The horizontal plates top and bottom on the box rudder cushion the up-and-down movements of the bow, and acts as a shock absorber. When the craft hits a swell and the bow goes up, the flat horizontal plates on the top and bottom scoop up water, tending to hold down the upward movement of the bow, and when the bow comes down these flat horizontal surfaces tend to hold back the downward movements of the bow. This smooths out the forward movement of the craft, with far less bouncing up and down. These flat horizontal plates could stick out from the sides.

The steering is done from the cab with a steering wheel connected to the rudder post by means of a sprocket chain and sprocket wheel. Alternatively, the steering could utilize hydraulic power (which would require a further hydraulic pump), shaft and gears, levers and rods, etc. The steering wheel is located on either side of the cab, to avoid interference with the turbine 42 located in the middle of the craft.

The air intake cylinder 32 mounted on top of the bow 20 is approximately three feet in diameter. It tapers back and downward towards the gas turbine 42.

A belly plate 33 under the back between the skis is part of the hull and is six feet long, eight feet wide, one-quarter inches thick, reinforced with cross strips curled up in front in a curved shape to slide over the water. This plate sets back approximately forty-four feet from the front and acts as an after-ski lifting the back up. There is an open space in front of the belly plate between the skis eight feet wide, twelve inches high, tapered down to the front of the belly plate in a curved shape, to scoop up the oncoming air. This creates a cushion of air under the craft.

The cab 16 is about nineteen feet long and eight feet wide. From the front the windshield tapers back and up like an automobile and is slightly round. There are four windows on each side, the back being mostly open. The average height inside the cab 16 is approximately six and one-half feet. This is made from heavy metal like the cab of a truck. There is a dashboard, seats, steering wheel and controls to raise and lower the nozzle and tail flap, and a throttle control for the gas turbine. At least two small hydraulic pumps operate the hydraulic cylinders that raise and lower the tail nozzle 36 and tail flap 26.

When the craft is stopped, just sitting down in the water, the exhaust nozzle 36 is raised up and out of the water. As the craft proceeds forward and comes up out of the water, the nozzle 36 is lowered down to the surface of the water and starts to plane over the water surface. That gives more push and increases the speed; then it is pushing against the surface of the water.

The tail wing 24 is nine feet across on top, about eight feet across underneath, about seven feet wide fore and aft, with a twelve inch flap 26 in the back that comes to an edge. The front is rounded and about six inches thick in front and tapers back and becomes thinner as it goes back just like the wing of an airplane. The tail flap 26 is about eight feet long, twelve inches wide, with hinges in front operated hydraulically like an airplane. The front is about two inches thick and tapers back to an edge.

The hydraulic lifting cylinders 34 are approximately twelve inches in diameter, about four feet long. They are connected on top to the underneath side of the tail wing 24 with hinge pins and linkage. On the bottom of the cylinders the rods coming down are approximately one and one-quarter inches in diameter. These are connected to the crosspiece and the back part of the exhaust nozzle 36 with mechanical hinge linkage. The center of the crosspiece is welded to a three-eights inches strap or collar about eight inches wide around the after part of the nozzle 36. On both sides there are guides welded to the inside of the tail section. The ends of the crosspiece ride on these guides. This keeps the nozzle 36 from moving from side to side when going forward. There is a hydraulic pump in the cab that runs the hydraulic system and high pressure pipe lines and high pressure hoses running from the pumps to the cylinders.

The arch strongback or trussing frame 38 is about fifty feet long from the front to the aft part of the skis, more than ten feet wide and about thirteen feet high. It is made from three inch angle iron, two inch pipe, or similar material. The arch truss is very important, for the craft being so long the hull is weak, and to keep the hull from breaking, this steel frame is added to greatly increase the strength of the hull 12. This greater length is an important feature of the invention. The longer the better for control and riding.

Flexible metallic hose or pipe 40 sets approximately in the middle of the craft upon the stern. It is about four feet long, three feet in diameter. The front end is secured to the craft and after outlet of the gas turbine, while the aft end is free to move up and down. This flexible sleeve is a large metallic high pressure and temperature-resistant pipe, like flexible steam pipe.

The exhaust nozzle 36 is made from ten-gauge alloy steel and is tapered. It is about twenty-four feet long, about three feet in diameter at the front end, about two and one-half feet diameter at the back end. The back end is elliptical-shaped to the sides, and is cut off at an angle parallel to the surface of the water. There is a reinforcement strap (ten gauge steel) welded around the end of the nozzle for strength.

Dual tail section 22 is wide and high and tapers back and up at an angle ten feet high from the bottom of the skis. The bottom is open between the two sides like a yoke or fork, so that the exhaust nozzle 36 can be lowered down to the water. This space at the bottom of the tail section is eight feet wide between the two sides and ten feet back from the tail end to the belly plate. This is all open, and over the top of the nozzle 36 is all open. In the back of the belly plate 33 there are two braces seven feet back that come down at an angle and across, one on each side; then open space to the stern bulkhead. On top of the stern bulkhead is the flexible high-pressure metallic hose 40.

The gas turbine 42, the source of power, sets about one-third back, a little before the center. When the craft picks up speed the front tends to rise up out of the water. Having the turbine 42 set forward helps hold the bow down. The turbine 42 will weigh a thousand pounds more or less, and be five or six feet long and three and one-half feet in diameter, more or less, depending on the size. The gas turbine 42 is the same as on an airplane. The air intake 32 comes in the front through a large metallic cylinder of twelve-gauge steel. It is slightly tapered with larger diameter in front. The front end is mounted on top of the bow 20, and from there the air is directed back and down to the gas turbine 42, then goes through the turbine and miles with fuel, builds up pressure and becomes a hot flare in the aft cylinder. This cylinder has to be made of high alloy metal, a high heat-resistant metal, to hold the hot high pressure gas, just like on an airplane. From there the hot gases go to the flexible pipe 40. This must also withstand high temperature and high pressure and must be made from high quality metal. From there the hot gases go to the exhaust nozzle 36. This pipe or nozzle is bigger in diameter in the front and tapers slightly back. The diameter in the back is smaller than the diameter in the front. This also must be made of good quality metal. This after-nozzle extends back and down between the two sides of the dual tail section 22 to the surface of the water. This big nozzle 36 (like a fire hose nozzle) can be raised or lowered from the cab.

Having a catamaran type hull 12 is very important; it is wider at the bottom and rides much more stable. The air space under the middle acts as a cushion for smoother riding. The hull has to be long in order for it to function properly, the longer the better for control and stability. The long pontoon skis 14 under both sides gives a flat surface effect while sliding over the surface of the water. The belly plate 33 under the rear three-fourths of the hull acts as an after-ski. This helps raise the back portion up out of the water and the craft will run flatter and smoother. The bow 20 is tapered to cut through the wind. This must be solidly constructed to withstand the great stress of high speed and choppy water surface and waves. The lower part of the bow 20 is up about twelve inches above the bottom of the skis 14. This gives a catamaran effect and allows for air to build up under the belly as it builds up speed and comes up out of the water, it starts to plane over the surface of the water.

Another new and improved feature of this invention is its greater length. To accomplish this there is an arch frame 38 over the top. Without this frame truss support the hull would be weak and bend and even break. With this new feature, this allows the craft to ride much smoother due to the increase in length and not bounce up and down while going forward through the water. The arch frame 38 running from the back to the after part of the bow sticks out on both sides, greatly increasing the strength of the hull 12 and making it more solid and more comfortable for riding and for easier control.

Another important feature is the tail wing 24 and flap 26. This sets back a long ways to give more lifting leverage to raise the back up and also acts as a cover over the back end of the tail nozzle 14. This box type tail section 22 provides a lifting effect in the back, and additionally holds the craft steady and keeps it from going up or down or sideways. That is why the steering has to be done from the front. The steering and operating, raising and lowering of the tail nozzle 36 and the wing flaps 26 moving up or down is done in the cab, as well as speeding up or down of the gas turbine 42, by three separate controls, something like being in an airplane. The fuel tanks are built inside the hull 12, and two small hydraulic pumps powered by a small internal combustion engine (or batteries) to operate the hydraulic cylinders in the back for raising and lowering the nozzle and for the wing flap position are located in the cab. In addition, a further hydraulic pump for power steering of the box rudder 30 could be included.

The raising of the tail nozzle 36, the steering and the moving of the wing flap 26 can also be done by mechanical means, with rods and cables and levers and gears. Finally, there is a portable outboard motor attached to the back for harbor maneuvering.

Finally, the craft includes the following series of skis/pontoon skis:

Front Pontoon Ski 50: A ski mounted between the two pontoons in front. This will create a full pontoon ski in front, not all the way back. The front of this center section is curved up about twelve inches and the bottom extends back about three feet. Joined between the two skis or welded on both sides on the bottom and front (a plate curved up in front).

Middle Pontoon Skis 52: One on both sides about half way back. Three feet wide, four feet long, twelve inches high. Built to the side of the craft, and braced going up from the approximate center of the pontoons at an angle to the side of the hull.

Aft pontoon skis 54: Spaced out about four feet from the back, extending further back, and spaced out from the sides, beyond the wake of the center skis, located further out from the sides than the middle pontoon skis. Three and one-half feet wide, four and one-half feet long, approximately, with braces going up at an angle from the middle of the top of the pontoons to the side of the tail section 22, and a brace going forward at an angle joined to the side of the hull up twenty inches from the bottom, and straight braces from the top of the pontoons to the side of the craft. They have to be out of the wake of the skis in front of them while going forward. To lift properly, the back of the ski will always go down. The back ski will raise the back of the craft, and allow the craft to plane over the surface of the water at high speeds.

Therefore, a combination of all these things working together is needed to obtain high speed over the surface of the water and to maintain good and steady control over the craft as well as comfortable riding in a strong, dependable, solid craft.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A high-speed watercraft comprising:

a catamaran hull having a bow, stern, and gunnel, said hull mounted on a pair of hull pontoon ski members;

at least one water chute member attached to the underside of each of said hull pontoon ski members proximate the stern;

a box rudder/water chute member attached to said hull proximate the bow;

a belly plate member attached to the underside of the hull proximate the stern and extending between said hull pontoon ski members;

a tail member including a tail flap;

an arch frame for structural reinforcement of said hull, said arch frame extending from proximate the bow to proximate the stern; and gas turbine propulsion means including an exhaust nozzle directed from said stern, said exhaust nozzle conditioned for vertical movement relative to said stern.

2. The high-speed watercraft of claim 1 further including:

a front pontoon ski connected to and extending between said hull pontoon ski members proximate the bow;

a pair of middle pontoon skis connected to and extending laterally outward a first distance from said hull pontoon ski members proximate the middle of said hull; and a pair of aft pontoon skis connected to and extending laterally outward a second distance greater than said first distance from said hull pontoon ski members proximate the stern.

3. The high-speed watercraft of claim 2 wherein said aft pontoon skis include duplex water chutes underneath, and said front pontoon ski includes flat plates to keep the front from going up and down.

* * * * *